US009623447B2

(12) United States Patent
Kataoka

(10) Patent No.: US 9,623,447 B2
(45) Date of Patent: Apr. 18, 2017

(54) WASHING APPARATUS COMPRISING A CAPSULE-SHAPED WASHING CHAMBER

(75) Inventor: Keiji Kataoka, Oakzaki (JP)

(73) Assignee: FINE MACHINE KATAOKA CO., LTD., Anjo-shi (JP)

( * ) Notice: Subject to any disclaimer, the term of this patent is extended or adjusted under 35 U.S.C. 154(b) by 1107 days.

(21) Appl. No.: 13/019,588

(22) Filed: Feb. 2, 2011

(65) Prior Publication Data

US 2012/0080063 A1 Apr. 5, 2012

(30) Foreign Application Priority Data

Oct. 1, 2010 (JP) ..... 2010-224111

(51) Int. Cl.

| | |
|---|---|
| ***B08B 3/00*** | (2006.01) |
| ***B08B 3/02*** | (2006.01) |
| ***B08B 5/02*** | (2006.01) |
| ***F26B 21/00*** | (2006.01) |
| *F26B 9/06* | (2006.01) |

(52) U.S. Cl.

CPC ..... *B08B 3/02* (2013.01); *B08B 5/02* (2013.01); *F26B 21/004* (2013.01); *F26B 9/06* (2013.01)

(58) Field of Classification Search

CPC ..... B08B 3/02; B08B 5/02; B08B 2203/0211; B08B 2203/0264; B08B 2203/02; H01L 21/67201

USPC ..... 134/198, 145

See application file for complete search history.

(56) References Cited

U.S. PATENT DOCUMENTS

| | | | | |
|---|---|---|---|---|
| 3,489,608 | A * | 1/1970 | Jacobs et al. | 134/25.4 |
| 4,520,903 | A * | 6/1985 | Arnold et al. | 187/222 |
| 4,917,136 | A * | 4/1990 | Ohmi et al. | 137/15.04 |
| 5,992,159 | A * | 11/1999 | Edwards et al. | 62/64 |

(Continued)

FOREIGN PATENT DOCUMENTS

| | | | |
|---|---|---|---|
| JP | 07-135137 | A | 5/1995 |
| JP | 2001232308 | A * | 8/2001 |

(Continued)

OTHER PUBLICATIONS

JP2003163147 Machine Translation, Jun. 2003.*

(Continued)

*Primary Examiner* — Michael Kornakov
*Assistant Examiner* — Marc Lorenzi
(74) *Attorney, Agent, or Firm* — Westerman, Hattori, Daniels & Adrian, LLP

(57) ABSTRACT

The conventional washing apparatus has a double-cup washing tank that joins and separates to let work be placed therein, with nozzles set on the inner cup to allow a passage between it and the outer cup for spent liquid and/or air. The work is cleaned by washing detergent spirally flowing along the periphery of the inner cup by suction power within the passage, and then dried. Suction is not generated within the inner cup, so the spiral flow is too weak to make the tornado effect. This invention though resolves the above issues by an encased washing apparatus having a capsule-shaped washing chamber that joins and separates, has nozzles thereon, has a work table within that rotates by a drive device, has a drain at the bottom, and is characterized by washing detergent, cleaning water and/or air swirling by negative pressure within the washing chamber and then discharging into a drain.

2 Claims, 7 Drawing Sheets

(56) References Cited

U.S. PATENT DOCUMENTS

| | | | | |
|---|---|---|---|---|
| 6,000,227 | A * | 12/1999 | Kroeker | H01L 21/67115 62/62 |
| 6,468,351 | B1 * | 10/2002 | Noda | H01J 37/32743 118/715 |
| 2004/0094190 | A1 * | 5/2004 | Robert | 134/108 |
| 2007/0283983 | A1 * | 12/2007 | Park et al. | 134/21 |
| 2008/0035182 | A1 * | 2/2008 | Nakatsukasa | H01L 21/02052 134/88 |
| 2008/0072931 | A1 * | 3/2008 | Kimura | 134/26 |

FOREIGN PATENT DOCUMENTS

| | | | | |
|---|---|---|---|---|
| JP | 2002126663 | A | * | 5/2002 |
| JP | 2003163147 | A | * | 6/2003 |
| JP | 2010125421 | A | * | 6/2010 |

OTHER PUBLICATIONS

JP2010125421—Machine Translation, Jun. 2010.*
JP2002126663—Machine Translation, May 2002.*
JP2001232308—Machine Translation, Aug. 2001.*
Japanese Office Action dated Jan. 9, 2014, issued in corresponding Japanese Patent Application No. 2010-224111 (2 pages).

* cited by examiner

WASHING APPARATUS COMPRISING A CAPSULE-SHAPED WASHING CHAMBER

FIELD OF THE INVENTION

This invention relates to a capsule-shaped work washing apparatus (a work washing apparatus comprising a capsule-shaped washing chamber).

BACKGROUND OF THE INVENTION

A conventional work washing apparatus has a casing (i.e. a case/box) structure in which a rotary work platform is provided with many nozzles that spray washing detergent, cleaning water and/or inject air toward the work. Thus, there are some negative effects such as the dispersion, adhesion and accumulation or the like of detergent and cleaning water within the casing. Another problem is that dirt or the like from the work attaches and accumulates within the casing. As such, additional work is required to remove the dirt from within the casing or the like, thus decreasing efficiency.

Here are two prior arts of a washing apparatus and equipment that may show how to solve the aforementioned problems.

Prior art Document One is "Japanese Published Unexamined Application No. 2004-89946" entitled, "Washing Apparatus" that refers to an inventive washing apparatus having a double-cup washing tank that joins and separates to let work be placed in it, with washing nozzles being provided on the inner cup of the double-cup structure to allow a flow passage between the inner and outer cups for discharging liquid and/or expelling air. Thus, the work is cleaned and dried in a hermetically enclosed washing tank. The invention is characterized by washing detergent being sprayed equally toward the work in a spiral flow to clean the work evenly and is characterized by the spiral flow being induced by suction power within the flow passage, with the spiral flow actually occurring along the periphery of the inner cup. Yet, since suction power is not generated within the inner cup (but along its periphery), such a spiral flow is too weak to induce the tornado effect, and since the double-cup washing tank is of semicircular shape, the spiral flow made within such a small area is limited. Also, of this structure, the work platform does not rotate, so much time is needed to clean the work. The invention is also characterized by the washing nozzles being integrated with the flow passage between the inner and outer cups to simplify the motion of the double-cup structure. Yet, this design makes the structure complicated and heavy. Thus, improvement is needed. Of this structure, the washing detergent, cleaning water and dirt or the like remaining on the work platform may spill out. Thus, handling and cleaning the apparatus is an issue.

Prior art Document Two is "Japanese Published Unexamined Application No. S58-210888" entitled, "Method for Washing and Drying Electrical Appliances." This invention refers to a structure by which the work having been placed on a table is transferred to a hermetically sealed process chamber to be cleaned by water being sprayed by upper and lower nozzles, with the wastewater and dirt being expelled through a discharge pipe provided at the bottom of the process chamber. In this invention, no tornado effect is likely to happen and is not expected. Also, the work platform does not rotate, so it may take long to clean the work.

Patent Document One is "Japanese Published Unexamined Application No. 2004-89946." Patent Document Two is "Japanese Published Unexamined Application No. S58-210888."

SUMMARY OF THE INVENTION

As described above, the prior inventions of Documents One and Two respectively have problems. They do not have the features of the present invention, as described below.

(a) A tornado effect is produced within an entirely hermetically sealed space, so that washing and drying are done efficiently with no dirt remaining inside the washing chamber, thus shortening the drying time.

(b) A tornado effect is produced within an entirely hermetically sealed space, so that within the washing chamber the dirt hurls downward with the washing detergent, cleaning water and/or air and does not remain inside, thus shortening the washing time and reducing the number of cleanings by the washing chamber, thus simplifying maintenance or the like.

(c) Nozzles for spraying washing detergent and cleaning water are provided on the upper movable half of the washing chamber that easily and smoothly raises and lowers, whilst a drain is provided at the bottom of the lower fixed half of the washing chamber.

(d) Nozzles for spraying washing detergent and cleaning water are set crosswise on the upper movable half of the washing chamber to produce a tornado effect to wash the work efficiently with no dirt remaining inside, thus shortening the washing time.

(e) A portal-shaped bracket with attached pipes, through which washing detergent, cleaning water and air flow respectively to the nozzles to be sprayed and injected onto the work expediently, is provided on the upper movable half of the washing chamber.

(f) A work platform is attached to a work table within the lower fixed half of the washing chamber to bring the work closer to the nozzles spraying the washing detergent, cleaning water and injecting air onto the work, thus producing a greater tornado effect to wash the work efficiently and to expel the dirt entirely from within the washing chamber, thus shortening the drying time or the like.

(g) A drain is provided at the bottom of the lower fixed half of the washing chamber to draw the now vaporized washing detergent and cleaning water and dirt or the like into a duct to be finally processed by a mist collector, so as to expel only purified air and not foul air into the factory.

Means to Solving the Problems

The first aspect of this invention achieves the aforementioned features (a), (b) and (f).

The first aspect of this invention is aimed at achieving within a casing a washing apparatus comprising a capsule-shaped washing chamber that opens and closes, with nozzles being provided thereon, with a drain being provided at the bottom, with a work table rotated by a drive device being provided within, characterized in that washing detergent, cleaning water and/or air swirl within the washing chamber and then discharges into the drain.

The second aspect of this invention achieves the aforementioned feature (c).

The second aspect of this invention is aimed at achieving a washing apparatus as described in the first aspect of this invention, characterized in that the washing chamber comprises a lower fixed half and an upper movable half, with the upper movable half being raised and lowered by a piston rod.

The third aspect of this invention achieves the aforementioned features (a), (c) and (d).

The third aspect of this invention is aimed at achieving a washing apparatus as described in the first aspect of this invention, characterized in that nozzles are set crosswise on the upper movable half of the washing chamber, with the vertically aligned nozzles being used for spraying washing detergent and cleaning water, with the horizontally aligned nozzles being used for injecting air, and with a drain joined to a duct being provided at the bottom of the lower fixed half of the washing chamber.

The fourth aspect of this invention achieves the aforementioned feature (e).

The fourth aspect of this invention is aimed at achieving a washing apparatus as described in the first aspect of this invention, characterized in that atop the upper movable half of the washing chamber is attached a portal-shaped bracket to which are joined two guide bars that protrude through the top panel of the casing and are joined to a support plate above the casing, with a cylinder set vertically between the two guide bars above the casing being joined to the casing and to the support plate.

The fifth aspect of this invention achieves the aforementioned feature (g).

The fifth aspect of this invention is aimed at achieving a washing apparatus as described in the fourth aspect of this invention, characterized in that joined to the portal-shaped bracket of the upper movable half of the washing chamber are two pipes through which washing detergent, cleaning water and air flow respectively to the washing chamber by tubes being joined to the two pipes and to the nozzles set on the upper half of the washing chamber.

Effect of the Invention

The first aspect of this invention refers to a washing apparatus within a casing, comprising a capsule-shaped washing chamber that opens and closes, with nozzles being provided thereon, with a drain being provided at the bottom, with a work table rotated by a drive device being provided within, characterized in that washing detergent, cleaning water and/or air swirl within the washing chamber and then discharges into the drain.

(a) A tornado effect is produced within an entirely hermetically sealed space, so that washing and drying are done efficiently with no dirt remaining inside the washing chamber, thus shortening the drying time.

(b) A tornado effect is produced within an entirely hermetically sealed space, so that within the washing chamber the dirt hurls downward with the washing detergent, cleaning water and/or air and does not remain inside, thus shortening the washing time and reducing the number of cleanings by the washing chamber, thus simplifying maintenance or the like.

(f) A work platform is attached to a work table within the lower fixed half of the washing chamber to bring the work closer to the nozzles spraying the washing detergent, cleaning water and injecting air onto the work, thus producing a greater tornado effect to wash the work efficiently and to expel the dirt entirely from within the washing chamber, thus shortening the drying time or the like.

The second aspect of this invention refers to a washing apparatus as described in the first aspect of this invention, characterized in that the washing chamber comprises a lower fixed half and an upper movable half, with the upper movable half being raised and lowered by a piston rod.

Therefore, the second aspect of this invention has the following feature.

(c) Nozzles for spraying washing detergent and cleaning water are provided on the upper movable half of the washing chamber that easily and smoothly raises and lowers, whilst a drain is provided at the bottom of the lower fixed half of the washing chamber.

The third aspect of this invention refers to a washing apparatus as described in the first aspect of this invention, characterized in that nozzles are set crosswise on the upper movable half of the washing chamber, with the vertically aligned nozzles being used for spraying washing detergent and cleaning water, with the horizontally aligned nozzles being used for injecting air, and with a drain joined to a duct being provided at the bottom of the lower fixed half of the washing chamber.

Therefore, the third aspect of this invention has the following features.

(a) A tornado effect is produced within an entirely hermetically sealed space, so that washing and drying are done efficiently with no dirt remaining inside the washing chamber, thus shortening the drying time.

(c) Nozzles for spraying washing detergent and cleaning water are provided on the upper movable half of the washing chamber that easily and smoothly raises and lowers, whilst a drain is provided at the bottom of the lower fixed half of the washing chamber.

(d) Nozzles for spraying washing detergent and cleaning water are set crosswise on the upper movable half of the washing chamber to produce a tornado effect to wash the work efficiently with no dirt remaining inside, thus shortening the washing time.

The fourth aspect of this invention refers to a washing apparatus as described in the first aspect of this invention, characterized in that atop the upper movable half of the washing chamber is attached a portal-shaped bracket to which are joined two guide bars that protrude through the top panel of the casing and are joined to a support plate above the casing, with a cylinder set vertically between the two guide bars above the casing being joined to the casing and to the support plate.

Therefore, the fourth aspect of this invention has the following feature.

(e) A portal-shaped bracket with attached pipes, through which washing detergent, cleaning water and air flow respectively to the nozzles to be sprayed and injected onto the work expediently, is provided on the upper movable half of the washing chamber.

The fifth aspect of this invention refers to a washing apparatus as described in the fourth aspect of this invention, characterized in that joined to the portal-shaped bracket of the upper movable half of the washing chamber are two pipes through which washing detergent, cleaning water and air flow respectively to the washing chamber by tubes being joined to the two pipes and to the nozzles set on the upper half of the washing chamber.

Therefore, the fifth aspect of this invention has the following feature.

(g) A drain is provided at the bottom of the lower fixed half of the washing chamber to draw the now vaporized washing detergent and cleaning water and dirt or the like into a duct to be finally processed by a mist collector, so as to expel only purified air and not foul air into the factory.

BRIEF DESCRIPTIONS OF THE FIGURES

PREFERRED EMBODIMENTS

Figure 1:
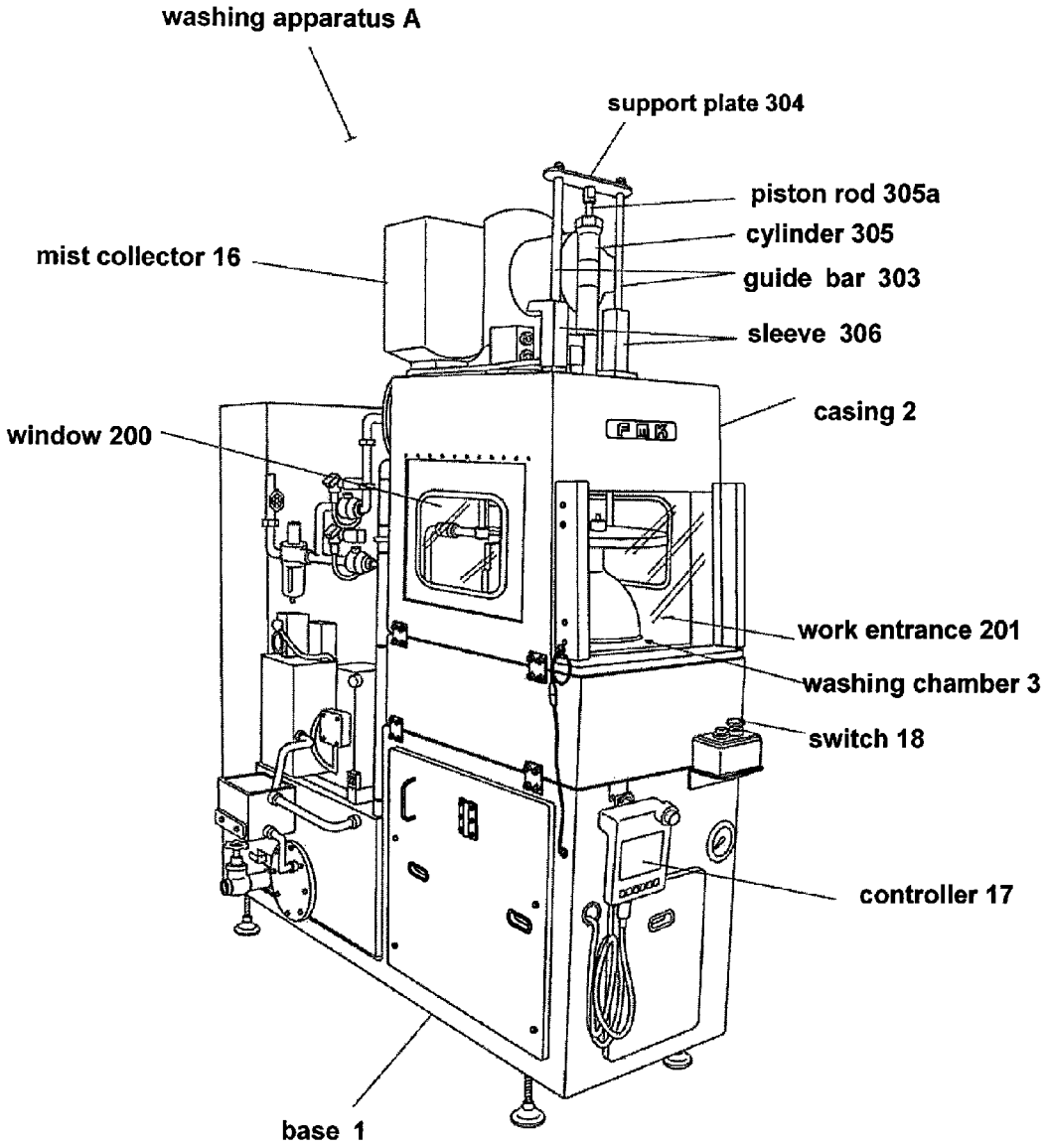
FIG. 1 is a perspective view of the washing apparatus comprising the enclosed capsule-shaped washing chamber of this invention.

The base 1 is the bottom unit of the washing apparatus A. The casing 2 is fixed upon the base 1. The casing 2 has a window 300 on both sides and a work entrance 201 in front. A washing chamber 3 provided within the casing 2 comprises a lower fixed half 300 with a support structure (not shown) built within the casing 2 and an upper movable half 301 (that can be separated from the lower fixed half 300) to form a hermetically enclosed space.

Figure 2:
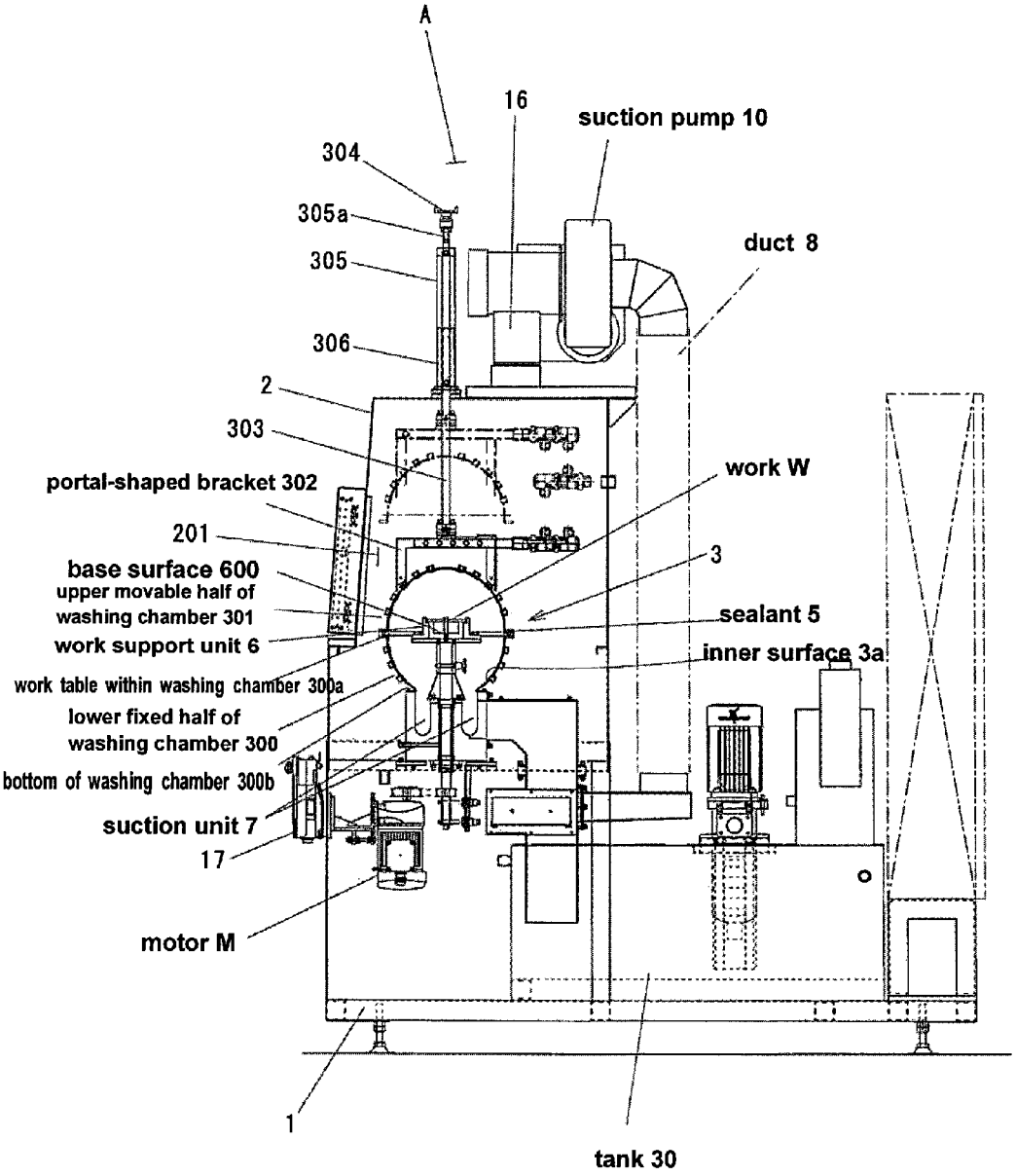
FIG. 2 is a conceptual side view of the washing apparatus without hoses.
Figure 3:
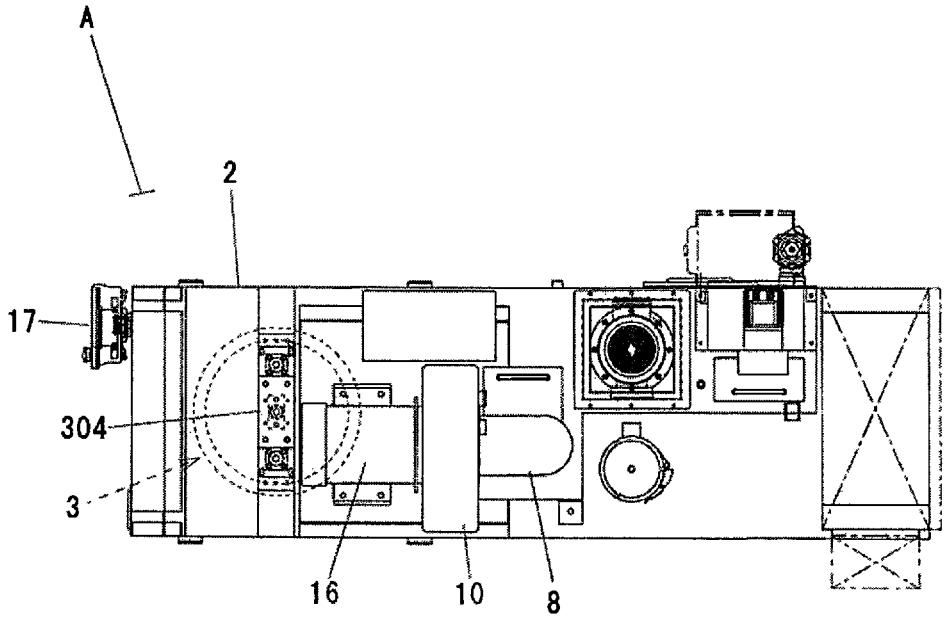
FIG. 3 is the conceptual top view of the washing apparatus.
Figure 4:
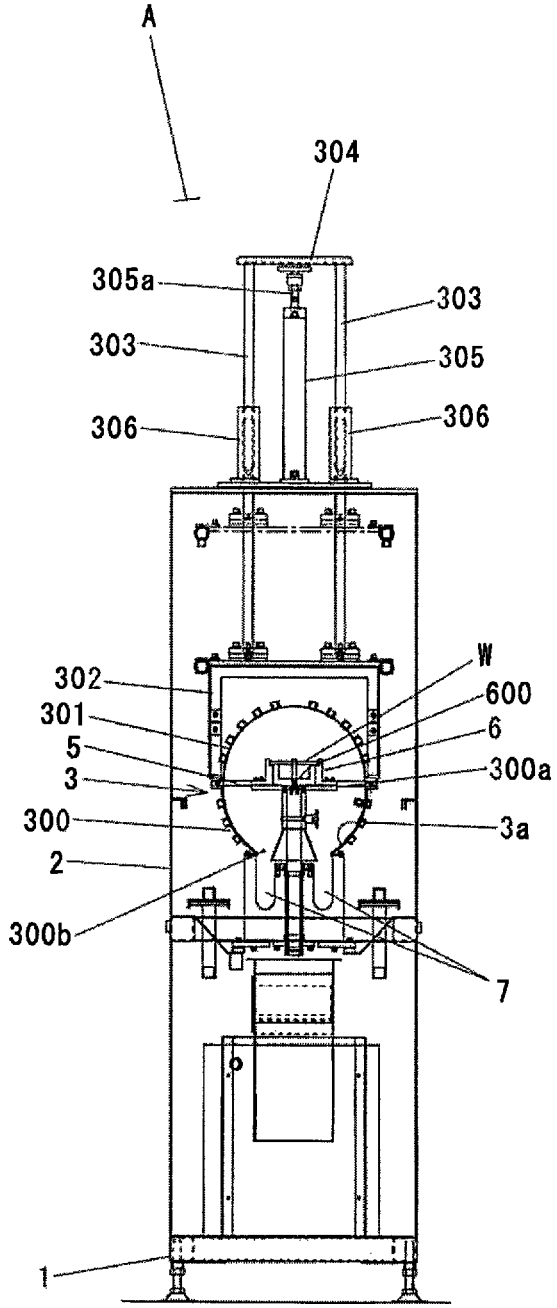
FIG. 4 is the conceptual frontal view of the washing apparatus without hoses.

The upper movable half 301 of the washing chamber 3 is provided within the casing 2. The embodiment shows the upper movable half 301 being a structure of which to a portal-shaped bracket 302 are joined two guide bars 303 that protrude through the top panel of the casing 2 and are attached to the support plate 304. A cylinder 305 is set vertically between the two guide bars 303 and is attached to the top panel of the casing 2 and to the support plate 304. When the piston rod 305*a* within the cylinder 305 rises, the two guide bars 303 (by being attached to the support plate 304) also rise. Simultaneously the portal-shaped bracket 302 (by being joined to the two guide bars 303) rises to lift the upper movable half 301 of the washing chamber 3 off of the lower fixed half 300 of the washing chamber 3. When the piston rod 305*a* within the cylinder 305 falls, the two guide bars 303 (by being attached to the support plate 304) also fall. Simultaneously the portal-shaped bracket 302 (by being joined to the two guide bars 303) falls to lower the upper movable half 301 of the washing chamber 3 onto the lower fixed half 300 of the washing chamber 3 to form a hermetically enclosed space. The sealant 5 is shown in FIG. 2 and FIG. 4. The two sleeves 306 partly cover the two guide bars 303 that protrude through the top panel of the casing 2.

A work support unit 6 with a work platform 600 is provided on a work table 300*a* within the lower fixed half 300 of the washing chamber 3 to shorten the distance B between the work W and the nozzles spraying washing detergent and cleaning water and injecting air onto the work, as described below, so as to produce a greater tornado effect C to efficiently wash the work without leaving dirt on the inner surface 3*a* of the washing chamber 3 and to shorten the drying time of the work W. The work table 300*a* is rotated by a motor reducer and/or transmission mechanism or the like linked to a motor M.

A drain 7 is provided at the bottom 300*b* of the lower fixed half 300 of the washing chamber 3 and is joined to a duct 8 that is joined to a suction pump 10. Whilst the washing chamber 3 is in use, the suction pump 10 with the duct 8 and the drain 7 keep negative pressure within the hermetically sealed washing chamber 3 to produce the tornado effect C which instantly draws the washing detergent, cleaning water, air and the dirt from the washing chamber 3.

Figure 5:
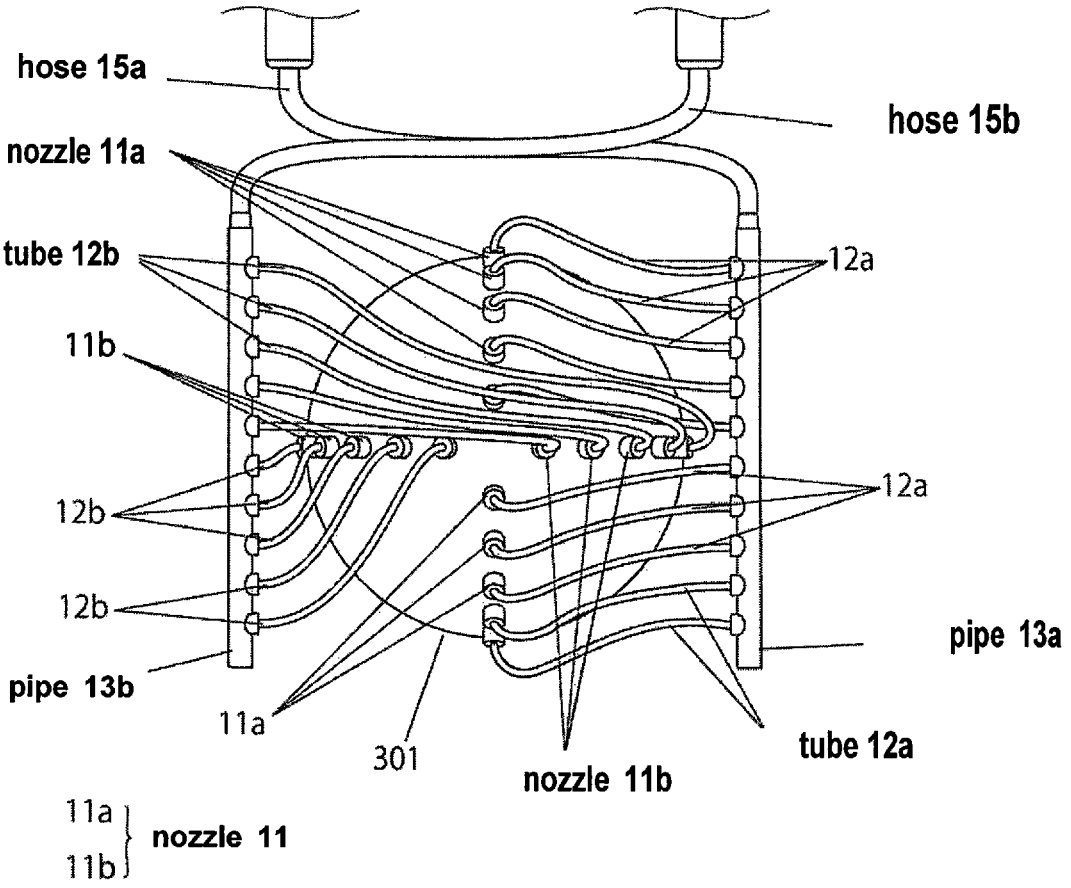
FIG. 5 is an enlarged schematic view of the branch hoses and pipes through which the washing detergent, cleaning water and air flow respectively to the washing chamber by tubes running from the pipes to the nozzles on the washing chamber.

A plurality of nozzles 11 is disposed on the upper movable half 301 of the washing chamber 3 and is arranged crosswise in a plan view (see FIG. 5). Longitudinally aligned nozzles 11*a* are used to direct the flow of washing detergent and cleaning water, whereas transversely aligned nozzles 11*b* are used to direct the flow of air. Nozzles 11*a*, 11*b* are joined to a supply source by the tubes 12*a*, 12*b* being joined to the pipes 13*a*, 13*b* and they in turn joined to the hoses 15*a*, 15*b*. Thus, from a supply source the washing detergent and cleaning water flow through the hose 15*a*, the pipe 13*a* and the tube 12*a* to be sprayed by the nozzle 11*a* into the hermetically sealed washing chamber 3, whilst from a supply source the air flows through the hose 15*b*, the pipe 13*b* and the tube 12*b* to be injected by the nozzle 11*b* into the hermetically sealed washing chamber 3. This embodiment is improved practically by having the portal-shaped bracket 302 bear the pipes 13*a*, 13*b* as well as the upper movable half 301 of the washing chamber 3 to make the portal-shaped bracket 302 more useful, so as not need to have to add another device to bear the pipes 13*a*, 13*b*, thus reducing cost and letting the washing apparatus A be made smaller to economize factory space.

FIG. 1 shows respectively the mist collector 16, the controller 17 and the switch 18.

Figure 7:
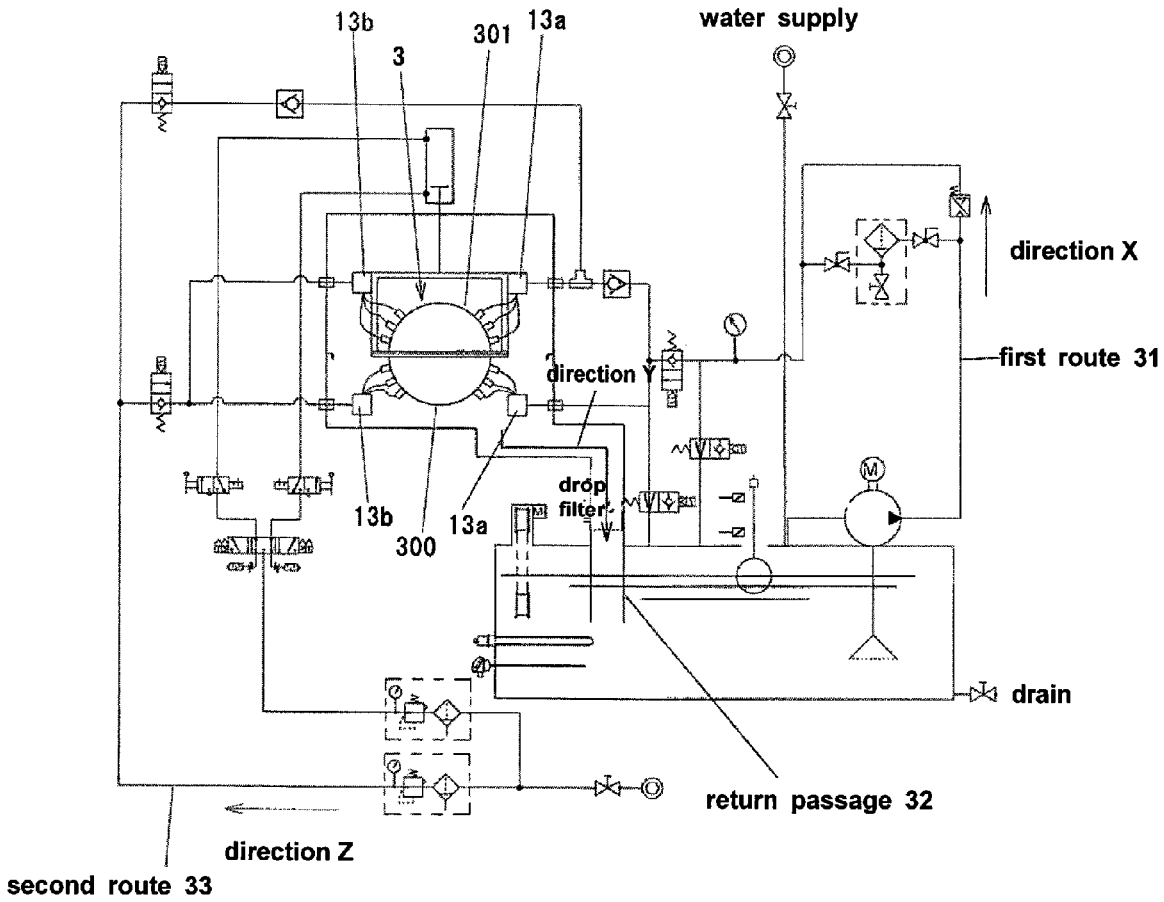
FIG. 7 shows the flow circuit of the washing detergent, cleaning water and the air.

FIG. 7 shows the direction of flow of the washing detergent, cleaning water (herein referred to as the water) and of the air. The water flows along the first route 31 that is joined to various devices including the tank 30 (not shown) and then is supplied in direction X to the water pipe 13*a*. The wastewater flows through the return passage 32 that has a filter branching from the drain 7 and then flows in the direction Y to the tank 30 to be reused. The air flows along the second route 33 that is joined to various devices including the blower (not shown) and then is supplied in the direction Z to the air pipe 13*b*. The dirty air is drawn by the suction pump 10 into the drain 7 and through the duct 8 to be processed by the mist collector 16 and then is emitted into the factory as purified air.

Figure 6:
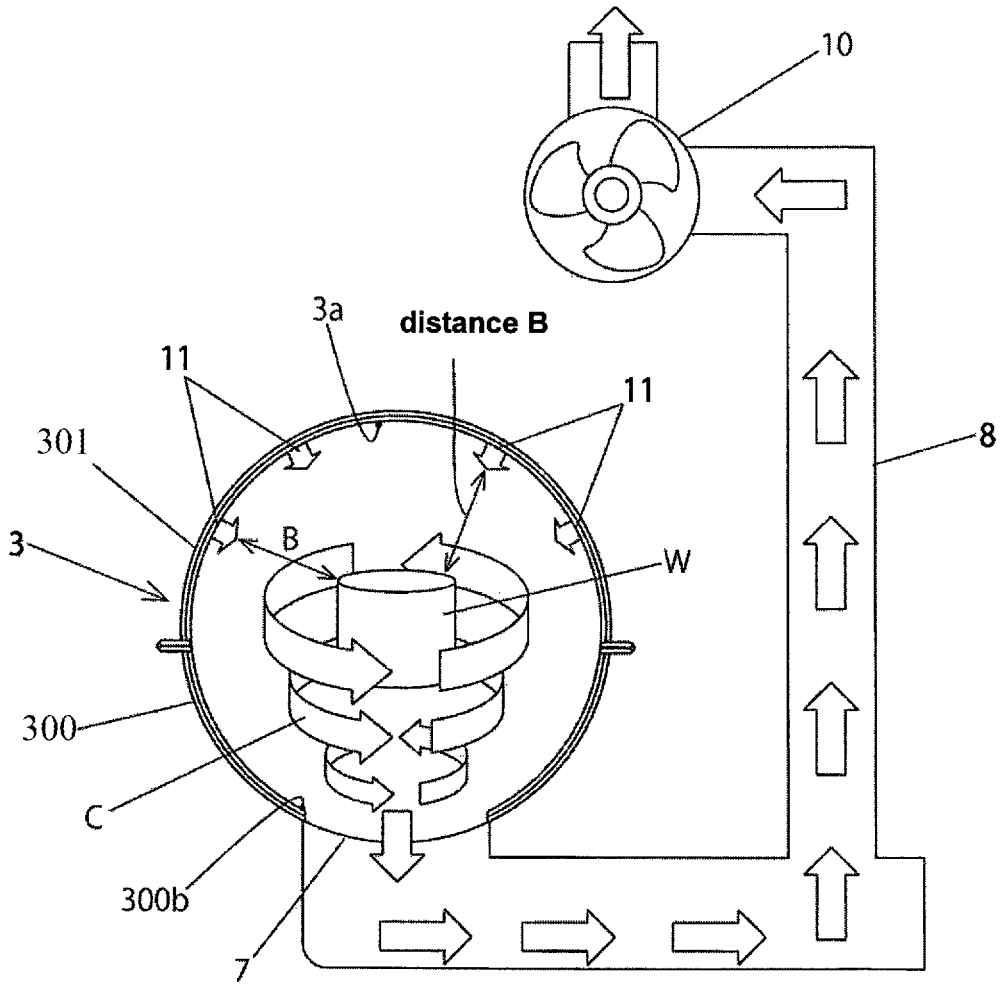
FIG. 6 is a simplified schematic view of both the tornado effect within the washing chamber and of the suction pump drawing the now vaporized washing detergent and cleaning water and the air into the drain and through the duct.

An example of the movement of this invention is explained as follows. The work entrance 201 is opened and the work W is set on the work support unit 6. After the work entrance 201 is closed and the switch 18 is turned ON, the work support unit 6 is rotated by the motor M, and a mixed liquid of water and detergent is sprayed from the nozzles 11*a*. As shown in FIG. 6, the washing chamber 3 is capsule-shaped, pressure is negative, the nozzles 11*a* are linearly aligned, the work W is arranged on the work table 300*a* of the lower fixed half 300 of the washing chamber 3 and is arranged flush with the work platform 600 of the work support unit 6, and the work W rotates. Thus the sprayed water swirls like a tornado. Thus due to this tornado effect C, good cleaning is performed in a short time. The wastewater by specific gravity then discharges into the drain 7 to return to the tank 30. The exhaust vapor flows through the duct 8 to be processed by the mist collector 16.

Thereafter, air for drying is injected from the nozzles 11*b*. As shown in FIG. 6, the washing chamber 3 is capsule-shaped, pressure is negative, the nozzles 11*b* are linearly arranged, and the work W is arranged on the work table 300*a* of the lower fixed half 300 of the washing chamber 3 and is arranged flush with the work platform 600 of the work support unit 6, and the work W rotates. Thus the sprayed air swirls like a tornado. Thus due to this tornado effect C, good cleaning is performed in a short time. The moist dirty air by specific gravity then discharges into the drain 7 to flow through the duct 8 to be processed by the mist collector 16.

After the work W has dried, disengage the switch 18. Open the work entrance 201. Remove the processed work W from the work platform 600. The operation is done.

Although it is not shown in the figures, the work W can be placed and removed automatically.

EXPLANATION OF THE ALPHA NUMERALS

1 base
2 casing
200 window
201 work entrance
3 washing chamber
3*a* inner surface of washing chamber
300 lower fixed half of washing chamber
300*a* work table within washing chamber
300*b* bottom of washing chamber
301 upper movable half of washing chamber
302 portal-shaped bracket
303 guide bar
304 support plate
305 cylinder
305*a* piston rod
306 sleeve
5 sealant
6 work support unit
600 work platform
7 drain
8 duct
10 suction pump
11 nozzle
11*a* nozzle
11*b* nozzle
12*a* tube
12*b* tube
13*a* pipe
13*b* pipe
15*a* hose
15*b* hose
16 mist collector
17 controller
18 switch
30 tank
31 first route
32 return passage
33 second route
A washing apparatus
B distance
C tornado effect
M motor
W work

We claim:

1. A washing apparatus within a casing, comprising:

a capsule-shaped washing chamber that opens and closes;

nozzles being provided on the capsule-shaped washing chamber;

a drain disposed at a bottom of the washing chamber; and a work support unit disposed within the washing chamber and rotatable by a drive device, wherein the capsule-shaped washing chamber includes a lower fixed half and an upper movable half, the lower fixed half having a curved portion and the upper movable half having a curved portion, wherein the nozzles are disposed along a curvature of the curved portion on the upper movable half, with a subset of the nozzles spraying washing detergent and cleaning water being arranged in a first direction, with another subset of the nozzles injecting only air being arranged in a second direction crossing the first direction to form a crosswise arrangement of the nozzles in a plan view, wherein the drain is disposed at a bottom of the lower fixed half of the washing chamber and is coupled to a suction pump, wherein during a washing operation, the work support unit is configured to rotate, the subset of the nozzles is configured to spray washing detergent and cleaning water, and the suction pump coupled to the drain is configured to activate to create a negative pressure for generation of a tornado effect in the washing chamber, the tornado effect including swirling water and whirling air within the negative pressure, wherein during a drying operation, the work support unit is configured to rotate, the another subset of the nozzles is configured to inject only air, and the suction pump is configured to activate to create the negative pressure for generation of the tornado effect in the washing chamber, wherein the washing apparatus further comprises:

a portal-shaped bracket attached atop the upper movable half of the washing chamber;

two guide bars coupled to the portal-shaped bracket on one end and coupled to a support plate above the casing on an opposite end, the two guide bars protruding through a top panel of the casing;

a cylinder disposed vertically above the casing between the two guide bars, the cylinder being coupled to the casing on one end and to the support plate on another end, and the upper movable half being raised and lowered by the cylinder;

a first pipe having a plurality of tubes, each of the plurality of tubes being respectively connected to each of the nozzles in the subset of the nozzles to supply the washing detergent and the cleaning water; and a second pipe having a plurality of tubes, each of the plurality of tubes of the second pipe being respectively connected to each of the nozzles in the another subset of the nozzles to supply the air, wherein the first pipe and the second pipe are coupled to the portal-shaped bracket of the upper movable half of the washing chamber, wherein the first pipe extends parallel to the first direction of the subset of the nozzles in the plan view, and wherein the second pipe extends perpendicular to the second direction of the another subset of the nozzles in the plan view.

2. The washing apparatus according to claim 1, wherein the work support unit includes a work platform arranged flush with a plane of an opening surface of the lower fixed half of the washing chamber.

* * * * *